US007610655B2

(12) United States Patent
Thaw et al.

(10) Patent No.: US 7,610,655 B2
(45) Date of Patent: Nov. 3, 2009

(54) FURNITURE GLIDE COVER

(76) Inventors: Richard E. Thaw, 7880 Woodsmuir Dr., West Palm Beach, FL (US) 33412; Philip Newman, 17044 Brookwood Dr., Boca Raton, FL (US) 33496

( * ) Notice: Subject to any disclaimer, the term of this patent is extended or adjusted under 35 U.S.C. 154(b) by 0 days.

(21) Appl. No.: 11/351,727

(22) Filed: Feb. 10, 2006

(65) Prior Publication Data

US 2007/0186374 A1 Aug. 16, 2007

(51) Int. Cl.
*A47B 91/06* (2006.01)
*B60B 33/00* (2006.01)

(52) U.S. Cl. ..... 16/42 R; 16/42 T; 16/43; 16/30; 248/188

(58) Field of Classification Search ..... 16/42 R, 16/42 T, 43, 30; 248/188, 188.8, 188.9
See application file for complete search history.

(56) References Cited

U.S. PATENT DOCUMENTS

| | | | | | |
|---|---|---|---|---|---|
| 771,679 | A * | 10/1904 | Stock | 248/188.9 |
| 2,996,753 | A * | 8/1961 | Kramcsak, Jr. | 16/42 R |
| 3,191,213 | A * | 6/1965 | Congdon | 16/42 R |
| 3,206,235 | A * | 9/1965 | Albinson et al. | 403/90 |
| 3,505,724 | A * | 4/1970 | Sator et al. | 29/432.2 |
| 3,516,112 | A * | 6/1970 | Neville et al. | 16/42 R |
| 3,646,633 | A * | 3/1972 | Meinhardt | 16/42 R |
| 3,722,026 | A * | 3/1973 | Wilhelmi | 16/42 T |
| 4,124,917 | A * | 11/1978 | Gilliland | 16/42 R |
| 4,923,158 | A * | 5/1990 | Saisho | 248/188.8 |
| 5,191,676 | A * | 3/1993 | Gerner | 16/42 T |
| 5,651,651 | A * | 7/1997 | Spencer | 411/372.6 |
| 5,988,574 | A * | 11/1999 | Podgorski et al. | 248/188.4 |
| 6,623,082 | B1 * | 9/2003 | Huang | 297/463.1 |
| 6,626,405 | B1 * | 9/2003 | Keast et al. | 248/188.9 |
| 6,866,338 | B2 * | 3/2005 | Mendenhall et al. | 297/239 |
| 6,869,052 | B2 * | 3/2005 | Keast et al. | 248/188.9 |
| 6,880,709 | B2 * | 4/2005 | Chen | 211/70.6 |
| 2006/0200938 | A1 * | 9/2006 | Dombroski | 16/42 R |

* cited by examiner

*Primary Examiner*—Victor Batson
*Assistant Examiner*—David C Reese
(74) *Attorney, Agent, or Firm*—Robert M. Downey PA

(57) ABSTRACT

An integrally molded glide cover has a top and a base that interlock together to surround and encapsulate the lower portion of an existing furniture glide. A rim protrudes downwardly from the bottom of the base and surrounds a recessed bottom surface for receiving an insert that is adapted for sliding on floors without damaging the floor surface. A hinge allows the base to close over the bottom of the glide and into direct alignment with locking prongs on the top for interlocked attachment of the base to the top using one hand and no tools. When interlocked, the top and base provide a tamper-proof permanent attachment that presents a low profile appearance closely resembling the exterior configuration of the encapsulated lower glide portion.

4 Claims, 3 Drawing Sheets

FURNITURE GLIDE COVER

BACKGROUND OF THE INVENTION

1. Field of the Invention

This invention relates to furniture glides on the bottom end of furniture legs and, more particularly, to a device that securely attaches to an existing furniture glide and provides a new floor engaging surface on the bottom of the device.

2. Discussion of the Related Art

Furniture glides are well known in the art for attachment to the bottom end of furniture legs in order to provide a sliding surface that allows the furniture to be easily moved across a floor surface, while also enhancing the appearance of the bottom ends of the furniture legs. Of particular relevance to the present invention are furniture glides that have an upper portion adapted to be attached to the tubular end of a furniture leg and a lower portion that includes a shoe assembly. The shoe assembly has a base slider element held within a crown by a rim or retaining flange. The base slider element is formed of a smooth, low friction material, such as nylon, and includes a relatively flat bottom surface for sliding engagement with the floor. Typically, a ball and socket arrangement is used to pivotally attach the lower portion to the upper portion so that the lower portion is able to move while the upper portion remains fixed to the furniture leg. This pivotal arrangement provides a self-leveling feature that allows the bottom surface of the furniture glides on all of the legs of the furniture item to lie flat and stable on the floor surface. An example of this type of furniture glide is seen in U.S. Pat. No. 5,010,621 to Bock.

Furniture glides of the type described above are used extensively in both commercial and home environments including, but not limited to, schools, institutions, convention centers, hospitals, government offices, laboratories, household kitchens and home offices. Usually, this type of furniture glide is found on stackable chairs, tables and desks that have metal tubular legs.

In the past, glides with flat bottom nylon sliders have performed satisfactorily on hard floor surfaces that contain asbestos. However, all schools and other institutions have been required to remove any materials that contain asbestos due to serious health concerns. In the school industry, carpeting and asbestos floor tiles have been ruled unsafe and must be removed and replaced with a safe alternative flooring material. Vinyl flooring has been approved as safe and has recently been installed in many schools, and continues to be installed in thousands of school buildings as a replacement to carpeting and asbestos floor tiles as well as in new school building construction. And, while vinyl floors are the number one choice in schools, a serious problem has begun to emerge as a result of the use of the existing furniture glides on vinyl floor surfaces. More particularly, the bottom of the furniture glides is causing serious damage to vinyl floor tiles as a result of dirt, dust and grit accumulating on the bottom surface of the furniture glides. Eventually, the grit becomes embedded in the slider material (e.g. nylon), turning the once smooth slider surface into a blacken abrasive surface. Once this happens, sliding movement of the furniture across the floor results in scratching and marring of the newly installed vinyl floor tiles. This has led to increased labor costs to schools in connection with maintenance of the floors and, particularly, stripping the floors and re-waxing the floors in order to remove unsightly marks and scratches. And, because the problem associated with the floor glides remains unresolved, the newly re-waxed floors become marred and scratched once again and in a short period of time.

In the past, others have proposed solutions to this problem. In particular, the furniture glide in U.S. Pat. No. 6,324,725 to Green provides a stippled bottom surface that displaces grit, dust and debris between the stipples as the furniture item (e.g. a chair) slides across the floor. In one embodiment, Green provides a cap that snaps over the existing furniture glide to provide the stippled bottom surface. However, retrofitting chairs, desks, tables and other furniture items with the Green furniture glide cap or other available products is a time consuming, laborious and a potentially costly task, particularly in a school that may have over 2,000 chairs and desks, with four legs on each chair and each desk, requiring replacement of over 16,000 chair glides in one school alone. And, because removal and replacement of chair glides, including the chair glide disclosed in the patent to Green, requires use of special tools, only the school maintenance personal (i.e. janitors) are able to perform the job. This places the burden of replacing possibly as many as 16,000 or more chair glides, or installation of caps over the existing glides, on one or two janitors in a particular school. These same janitors have a full schedule of normal maintenance duties and, thus, a job such as replacing chair glides or installing caps like the one disclosed in the patent to Green will most likely have to be performed as overtime work. This would require many months of overtime pay at significant expense to the school system. Students, on the other hand, always seem to have a need to tamper with fixtures on the school furniture and will eventually remove anything that will break lose, even the Green furniture glide cap. Accordingly, there remains an urgent need for a satisfactory solution that provides for quick installation without tools and which will withstand abuse and tampering without becoming dislodged.

SUMMARY OF THE INVENTION

The present invention provides an integrally molded furniture glide cover having a top and a base that interlock together to surround and encapsulate the shoe assembly on the lower portion of an existing furniture glide. The base has an annular rim that protrudes downwardly from its bottom to provide a recessed area for receiving a floor engaging insert. The insert is bonded to the recessed area on the bottom surface with a suitable adhesive. The rim prevents flattening, distortion and separation (e.g. sheering or peeling off) of the insert when the furniture item (e.g. a chair) slides across the floor with a heavy load weighing down on the insert. In a preferred embodiment, the insert is a high density, hardened and long lasting felt pad that is imperious to most floor chemicals and water resistant. The top of the cover device is formed with a central opening and a slot communicating with the central opening to allow the top to be slipped onto the existing furniture glide and around the connecting stem and ball joint between the upper portion and the shoe assembly of the furniture glide. When the top of the cover is seated in position on the crown of the lower portion of the furniture glide, the base of the cover is fitted over the bottom of the existing glide and secured to the top portion. A hinge arrangement between the base and the top allows the base to swing onto the bottom of the shoe assembly of the existing chair glide and into locked engagement with the top of the cover, while ensuring that locking prongs on the top properly align for receipt and interlocking engagement within corresponding openings on the base. This action is performed easily, in less than 5 seconds, with the use of one hand and no tools. Once the top and base are snapped together and the prongs are locked within the respective openings, the cover is tamper-proof cannot be removed from the encapsulated lower glide portion.

While a hardened felt disk is used as the floor engaging insert in accordance with a preferred embodiment, it is noted that there are many types of inserts (i.e. different materials, shapes, textures) that can be installed within the recessed area on the underside of the base of the glide cover, each being useful for a specific purpose. The following are examples of floor engaging inserts that can be used with the furniture glide cover device:

1. Hard Felt Insert—non-marring, smooth sliding, polishing effect, quiet (ideal for classroom, library, conference room, convention centers, etc.)
2. Skid-Proof Rubber Insert—ideal for use in hospitals, labs, offices, factories, etc.
3. Teflon Insert—allow for ease of moving tables, pedestals, desks, and other large furniture items on a smooth, floor surface.
4. Nylon—ideal for use on carpeting or rugs.

The above described insert types are provided for example purposes. The insert types that can be used with the glide cover device of the present invention are not limited to those described above, and numerous other type of inserts are contemplated within the spirit and scope of the invention.

OBJECTS OF THE INVENTION

Considering the foregoing, it is a primary object of the present invention to provide an inexpensive, one piece, integrally molded cover device for fixed, interlocked and tamper resistant attachment to the lower portion of an existing furniture glide without the use of any tools, and wherein the cover device includes a recessed bottom surface surrounded by a protective rim for receipt of a glide insert formed of any suitable material and design that promotes sliding of furniture across a floor surface without scratching, marring or otherwise damaging the floor surface.

It is a further object of the present invention to provide a furniture glide cover device having a top and a base that interlock together and encapsulate the lower portion of the existing furniture glide, and wherein the cover device can be installed on the existing furniture glide without the use of any tools and in less than five seconds.

It is still a further object of the present invention to provide a furniture glide cover having a top and bottom that interlock together and encapsulate the lower portion of an existing furniture glide, and wherein the cover device is tamper-proof and remains permanently attached to the existing furniture glide.

It is still a further object of the present invention to provide a furniture glide cover device having a top and a base that interlock together and encapsulate the lower portion of an existing furniture glide, and wherein the cover device further includes a hinge between the top and base to allow for ease of interlocking attachment of the top and base with the use of just one hand and without any tools, while also ensuring exact alignment of prongs on the top for interlocking engagement with the base, thereby increasing the speed of installation.

It is still a further object of the present invention to provide an inexpensive, integrally molded cover device for interlocked attachment on an existing furniture glide, and wherein the cover device can be installed by any individual, with no tools and in less than five seconds, thereby significantly reducing the time and labor cost to schools and institutions when retrofitting existing furniture glides with the cover device of the present invention.

It is still a further object of the present invention to provide an inexpensive, integrally molded furniture glide cover device that is adapted for fixed, permanent installation, and wherein the furniture glide cover device can be installed by an unskilled person, including a school teacher or student, and wherein one person can easily install 4 cover devices on the existing glides of a chair in approximately 30 seconds, thereby enabling an unskilled person to easily install the cover device on a minimum of 75 chairs per hour.

It is still a further object of the present invention to provide an inexpensive, integrally molded furniture glide cover device having a top and a base that interlock together and encapsulate the lower portion of an existing furniture glide, and wherein the top and the base are structured and configured to provide a streamlined, smooth, glove-fit appearance over the existing furniture glide, thereby making the cover device unnoticeable when installed on the bottom ends of furniture legs.

It is still a further object of the present invention to provide a furniture glide cover device that encapsulates the lower portion of an existing furniture glide, and wherein the cover device includes a protective rim surrounding a recessed bottom surface for receiving a felt pad that is particularly suited for sliding on vinyl floor tiles without scratching, marring or damaging the vinyl floor surface, and further wherein the felt pad provides a polishing affect when sliding on vinyl floor surfaces.

It is yet a further object of the present invention to provide an inexpensive, integrally molded furniture glide cover device that encapsulates the lower portion of an existing furniture glide, and wherein the cover device includes a protective rim surrounding a recessed bottom surface that allows for bonded attachment, replacement and/or interchanging of various floor engaging inserts.

It is still a further object of the present invention to provide a furniture glide cover device that is adapted for permanent, fixed installation over an existing furniture glide, and wherein the furniture glide cover device is adapted to receive removable and interchangeable inserts of various material composition, thereby eliminating the need to ever have to replace a glide or glide cap in the future.

It is yet a further object of the present invention to provide a furniture glide cover device that is adapted to receive a hard felt insert disk that is made of a proprietary material that is particular suited for use on school chair glides for sliding on vinyl floor surfaces, and wherein the felt insert disk is impervious to most floor chemicals, as well as being water resistant.

It is still a further object of the present invention to provide a furniture glide cover device that is adapted for fixed, permanent installation over an existing furniture glide, and wherein the cover device is adapted to receive replaceable floor engaging inserts, thereby saving the costs of replacing a new glide or glide cap.

It is still a further object of the present invention to provide a furniture glide cover device which is adapted for fixed, permanent installation over an existing furniture glide, and wherein the cover device is adapted to receive floor engaging inserts that can be replaced at a fraction of the cost of the furniture glide or glide cap replacement cost.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
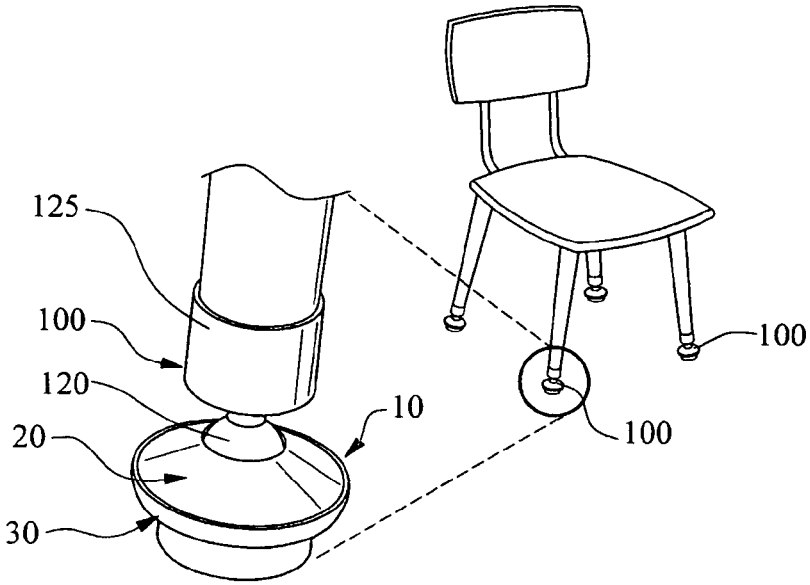
FIG. 1 is a perspective view of a chair showing an isolated brake-away view of the lower end of a leg of the chair with the furniture glide cover of the present invention fitted in encapsulating attachment over a glide on the bottom end of the chair leg.
Figure 2:
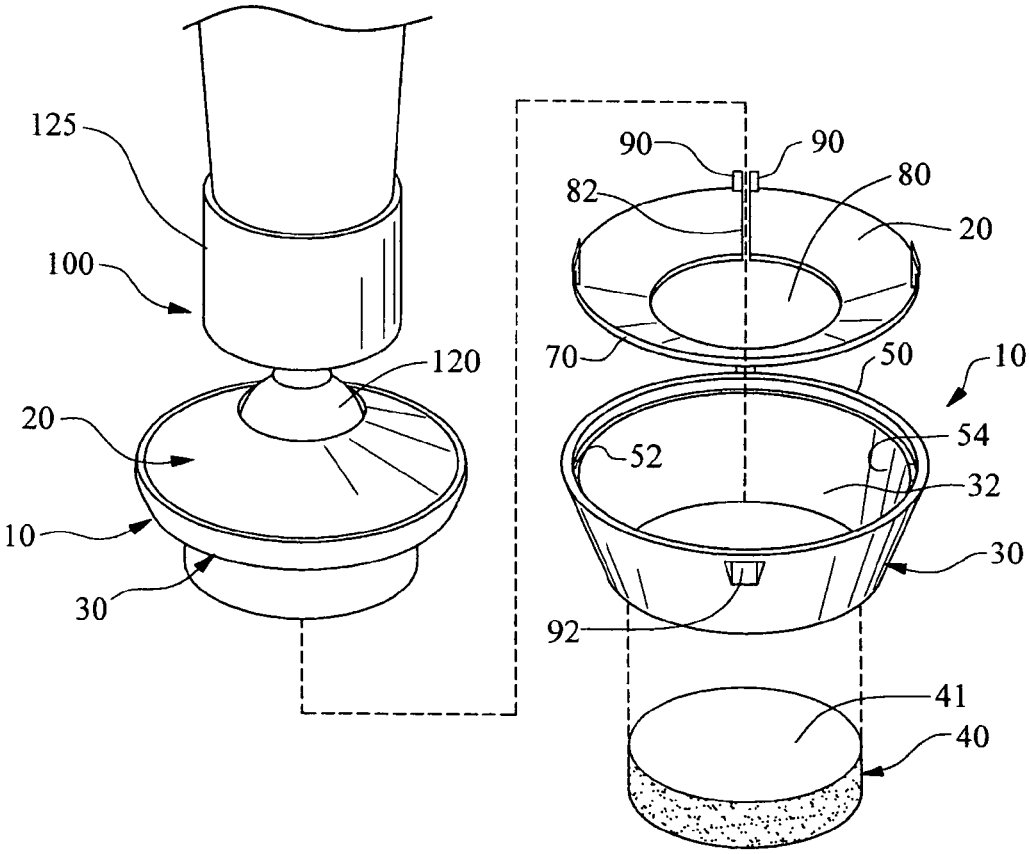
FIG. 2 is an isolated perspective view of the lower end of the chair leg with an exploded break-away of the furniture glide cover to illustrate the manner of assembly and attachment of the furniture glide cover to the glide on the bottom end of the chair leg.

Referring to the several views of the drawings, the furniture glide cover device is shown and is generally indicated as 10. The glide cover device includes at least two components that interlock together. In several preferred embodiments, the two components include a top 20 and a base 30. When interlocked, the top 20 and the base 30 surround an interior chamber 32 that is congruently shaped and configured for nested, encapsulated receipt of the furniture glide 100 therein, as shown in FIGS. 3*a*-4 and 7.

The base 30 has an annular rim 34 that protrudes downwardly from the bottom to provide a recessed area 36 for receiving a floor engaging insert 40. The insert 40 is bonded to the recessed area 36 on the bottom surface with a suitable adhesive. In one embodiment, a double-sided adhesive membrane or tape is used for bonding between the top side 41 of the insert and the surface of the recessed area. In a preferred embodiment, the insert 40 is high density, hardened and long lasting felt pad that is water resistant and impervious to most floor chemicals. The rim surrounds the insert and prevents flattening, distortion and separation (e.g. sheering or peeling off) of the insert 40 when the furniture leg slides across the floor surface with a heavy load weighing down on the insert. As seen in FIGS. 3*a*-4 and 6-7, the felt pad insert, or other insert material, preferably extends down a considerable distance below the rim 34 so that the bottom floor engaging surface 42 of the insert 40 rests on the underlying floor surface without the rim 34 contacting the floor surface. It is noted, however, that the insert 40, such as a felt pad, may wear down over time so that the rim 34 may eventually engage the floor surface. The cover device 10, including the rim, is formed of a smooth, high quality plastic composition or other material which will not scratch, mar or otherwise damage the floor surface. However, in the event the insert 40 does wear down to this level, so that the rim 34 hits the floor surface, the insert 40 is easily removed and replaced with a new insert that will protrude down below the rim, thus avoiding continued contact of the rim on the floor surface.

Figure 5:
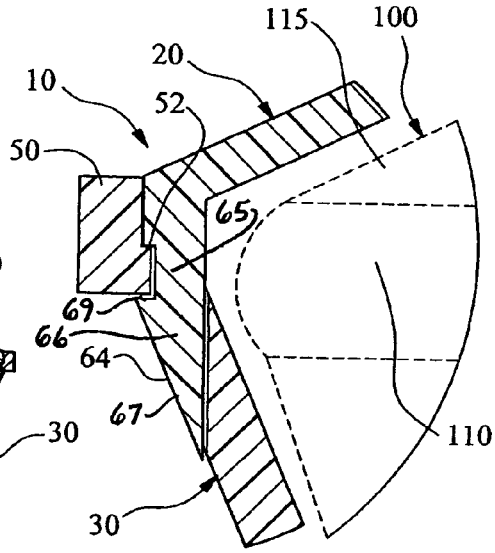
FIG. 5 is an isolated cross sectional view taken from the area indicated by arrows 5-5 and FIG. 4.

As seen in FIGS. 2 and 5-7, the open top of the base 30 is surrounding by a top peripheral edge 50 with a recessed shoulder 52 about the inner wall surface 54 of the base 30, just below the peripheral top edge. The top 20 of the cover device 10 is hinged to the base 30 with one or more integrally formed hinge members 60. The hinged attachment allows the top 20 to remain attached with the base 30, as a one piece unit, while also providing for ease of attachment to the furniture glide 100, assuring that the top 20 closes in proper alignment onto the base 30 so that locking prongs 64 extending downwardly from the outer periphery 70 of the top 20 remain aligned for interlocked receipt within notched openings 68 formed in the side wall of the base 30, below the inner shoulder 52. When the top 20 is closed down onto the base 30, the peripheral edge 70 of the top seats down within the peripheral top edge 50 of the base 30 and against the inner shoulder 52 of the base, as best seen in FIG. 5. When completely closed and seated within the base, the locking prongs 64 on the top snap into interlocked receipt within the correspondingly positioned notched openings 68. Specifically, the locking prongs 64 each include a finger extension 65 and a head 66 on the end of the finger extension. The head 66 has a sloped outer surface 67 to promote receipt of the head into the notched opening 68. An abrupt shoulder 69 below the sloped outer surface 67 snaps into engagement with the notched opening 68, preventing removal of the head 66 in a reverse motion, and thereby locking the prong 64 therein. This provides a tamper-proof attachment, preventing a flat edge device, such as a knife or screw driver, from being inserted between the top 20 and the base 30 in an attempt to pry the top 20 open.

Figure 3A:
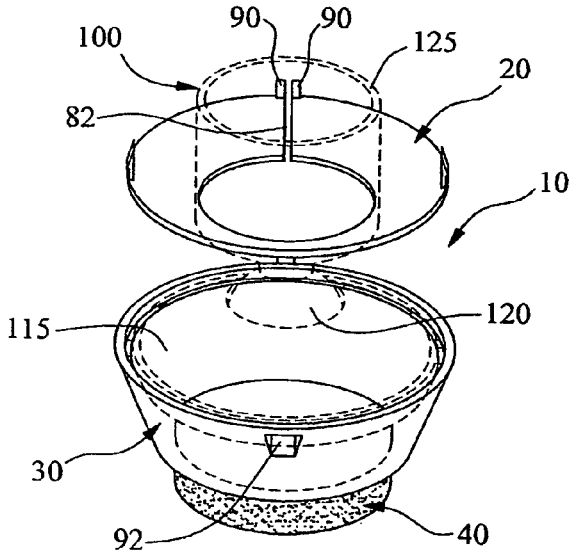
FIG. 3*a* is a perspective view of the furniture glide cover device shown in an open position and partially fitted to a furniture glide which is shown in phantom.
Figure 3B:
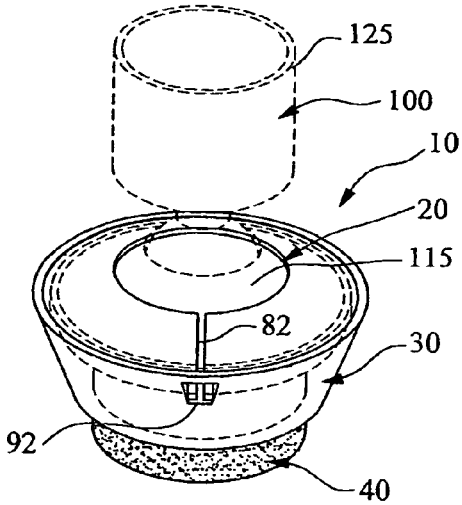
FIG. 3*b* is a perspective view of the furniture glide cover device shown closed and attached to encapsulate the furniture glide, and wherein the furniture glide is shown in phantom.
Figure 4:
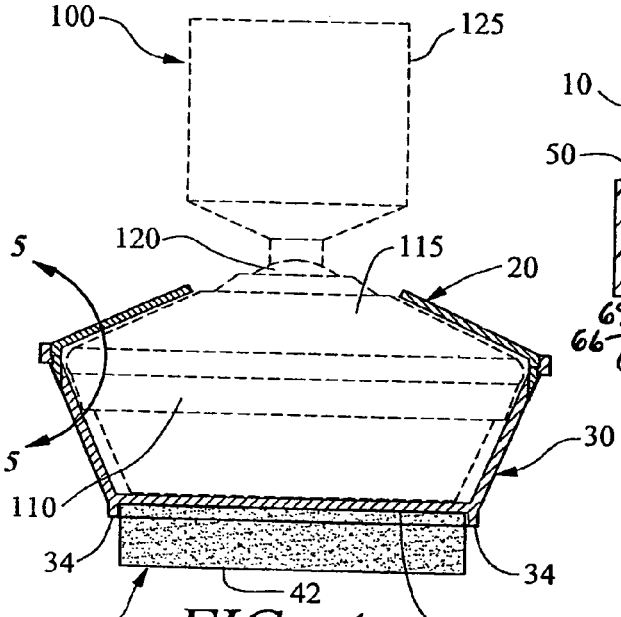
FIG. 4 is a cross sectional view of the furniture glide cover device shown attached to a furniture glide, wherein the furniture glide is shown in phantom.
Figure 6:
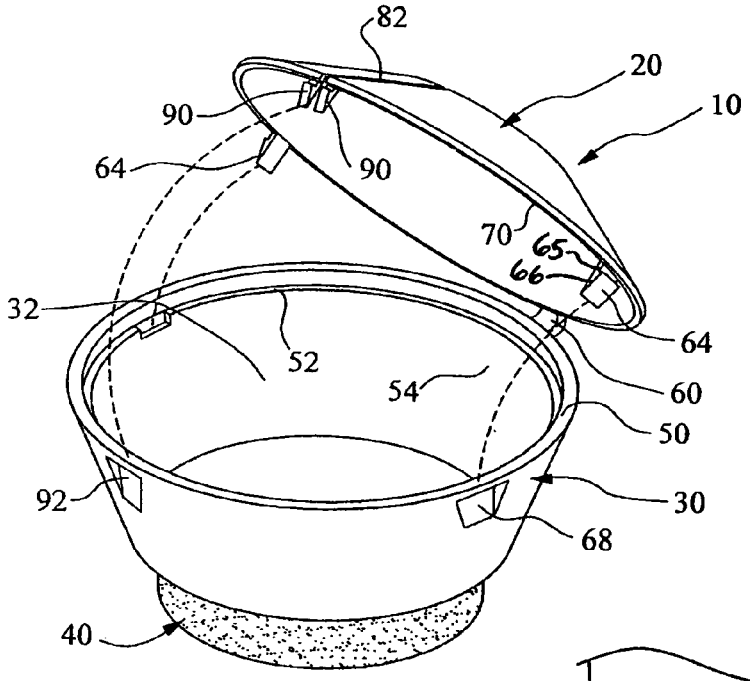
FIG. 6 is a top perspective view of the furniture glide cover in a partially open position and illustrating hinged movement of a top portion towards a closed position in interlocked attachment with a base of the glide cover device.
Figure 7:
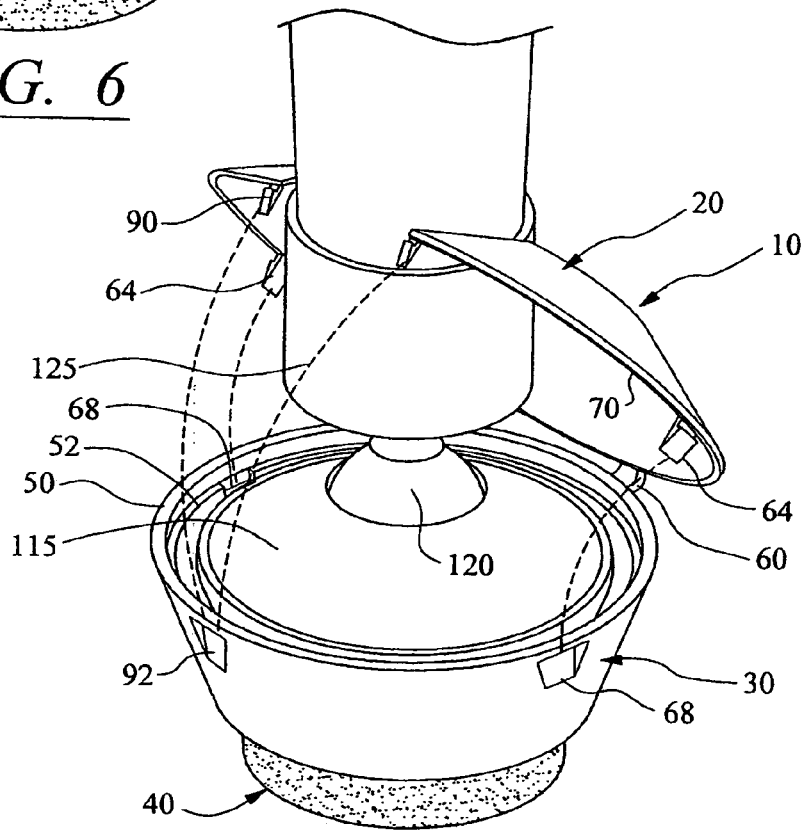
FIG. 7 is perspective view of a lower end portion of a furniture leg, illustrating attachment of the furniture glide cover device in interlocked, encapsulating and tamper-proof attachment over the furniture glide of the bottom end of the leg.

The top 20 of the cover device 10 is sized and configured to fit over the crown surface 115 of the shoe assembly 110 of the furniture glide 100, as shown in the drawings. A central opening 80 is formed in the top 20 for surrounding an interconnecting ball joint 120 of the glide 100 so that the top rests in seated position on the crown 115 of the shoe assembly 110. A radial slot 82 extends from the outer peripheral edge 70 of the top to the central opening 80, allowing the top 20 to be slipped around the lower end of the furniture leg, the top portion 125 of the existing furniture glide 100 and down into the closed, interlocked connection with the base 30 as seen in FIG. 7. The material of the cover device is such that the top is able to flex slightly so that the slot 82 can expand and spread around the bottom end of the furniture leg and upper glide portion 125, as seen in FIG. 7, thereby allowing for ease of quick installation by any unskilled person without the use of tools. Once the top 20 passes completely around the upper glide portion and is seated onto the crown 115 of the lower glide portion 110, the radial slot 82 returns to its original, relaxed state, leaving only a narrow gap, as seen in FIG. 3*b*. To further enhance the tamper-proof interlocked attachment of the top 20 to the base 30, a pair of prongs 90 are provided on opposite sides of the radial slot 82, along the peripheral edge 70 of the top 20, for interlocked receipt within a notch openings 92 on the base 30. These locking prongs 90, as seen in FIGS. 6 and 7, may be used to further secure the connection between the top 20 and the base 30 and to prevent prying the top open by inserting an object within the radial slot 82 when the cover device 10 is interlocked and secured to the furniture glide 100.

While the present invention has been shown and described in accordance with a preferred and practical embodiment, it is recognized that departures from the instant disclosure are contemplated within the spirit and scope of the present invention which is not to be limited except as defined in the accompanying claims, as interpreted under the doctrine of equivalence.

What is claimed is:

1. A cover device for use on a furniture glide that is attached on the bottom end of a leg of an article of furniture, the furniture glide having a base and a crown, said cover device comprising:

a bottom member having an inner surface, an upper peripheral edge surrounding an upper opening sized and configured for receipt of the base of the furniture glide therethrough, and a recessed shoulder formed about the inner surface below the upper peripheral edge, and a bottom exterior side;

a top member including an inner surface, a lower peripheral edge surrounding a lower opening, an upper central opening and a radial slot extending from said lower peripheral edge to said upper central opening for allowing the leg of the article of furniture to pass through said radial slot from said outer peripheral edge and into said central opening;

at least one hinge member integrally formed with said bottom member and said top member for allowing hinged movement of said bottom and top members relative to one another between an open position defined by said bottom member being separated from said top member with said at least one hinge member extending between said bottom and top members, and a closed position defined by said lower peripheral edge of said top member disposed in seating engagement against said recessed shoulder and below said upper peripheral edge of said bottom member;

said inner surfaces of said bottom and top members surrounding an interior cavity when said bottom and top members are in said closed position, and said inner surfaces of said bottom and top members being congruently sized and configured to conform to an exterior configuration of the furniture glide to prevent relative movement between said bottom and top members and the furniture glide when said bottom and top members are disposed in the closed position with the furniture glide captivated within the interior cavity;

a cooperating interlocking prong and notch structure for interlocking said bottom and top members together in said closed position; and a floor engaging surface on said bottom exterior side of said bottom member for sliding engagement with a floor surface.

2. The cover device recited in claim 1 further comprising:

a felt pad attached to the bottom exterior side of said bottom member and defining said floor engaging surface.

3. The cover device as recited in claim 2 further comprising:

a rim protruding downwardly from said bottom exterior side of said bottom member and surrounding a recessed area for receiving said felt pad, and said rim being structured and disposed for retaining said felt pad within said recessed area.

4. A cover device for use on a furniture glide that is attached on the bottom end of a leg of an article of furniture, the furniture glide having a base and a crown, said cover device comprising:

a bottom member having an inner surface, an upper peripheral edge surrounding an upper opening sized and configured for receipt of the base of the furniture glide therethrough, and a recessed shoulder formed about the inner surface below the upper peripheral edge, and a bottom exterior side;

a top member including an inner surface, a lower peripheral edge surrounding a lower opening, an upper central opening and a radial slot extending from said lower peripheral edge to said upper central opening for allowing the leg of the article of furniture to pass through said radial slot from said outer peripheral edge and into said central opening;

at least one hinge member integrally formed with said bottom member and said top member for allowing hinged movement of said bottom and top members relative to one another between an open position defined by said bottom member being separated from said top member with said at least one hinge member extending between said bottom and top members, and a closed position defined by said lower peripheral edge of said top member disposed in seating engagement against said recessed shoulder and below said upper peripheral edge of said bottom member;

said inner surfaces of said bottom and top members surrounding an interior cavity when said bottom and top members are in said closed position, and said inner surfaces of said bottom and top members being congruently sized and configured to conform to an exterior configuration of the furniture glide to prevent relative movement between said bottom and top members and the furniture glide when said bottom and top members are disposed in the closed position with the furniture glide captivated within the interior cavity;

a cooperating interlocking prong and notch structure for interlocking said bottom and top members together in said closed position;

a floor engaging surface on said bottom exterior side of said bottom member for sliding engagement with a floor surface;

a felt pad attached to the bottom exterior side of said bottom member and defining said floor engaging surface; and a rim protruding downwardly from the bottom exterior side of said bottom member and surrounding a recessed area for receiving said felt pad and said rim being structured and disposed for retaining said felt pad within said recessed area.

* * * * *